US009325123B2

(12) United States Patent
Yu

(10) Patent No.: US 9,325,123 B2
(45) Date of Patent: Apr. 26, 2016

(54) ELECTRICAL CONNECTOR WITH DETECTING CONTACTS

(71) Applicant: FOXCONN INTERCONNECT TECHNOLOGY LIMITED, Grand Cayman (KY)

(72) Inventor: Chun-Ming Yu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/566,735

(22) Filed: Dec. 11, 2014

(65) Prior Publication Data

US 2015/0162711 A1 Jun. 11, 2015

(30) Foreign Application Priority Data

Dec. 11, 2013 (CN) ..... 2013 2 0807237 U

(51) Int. Cl.

| | |
|---|---|
| ***H01R 29/00*** | (2006.01) |
| ***H01R 13/703*** | (2006.01) |
| ***H01R 13/641*** | (2006.01) |
| *H01R 107/00* | (2006.01) |

(52) U.S. Cl.

CPC ..... *H01R 13/7033* (2013.01); *H01R 13/641* (2013.01); *H01R 2107/00* (2013.01)

(58) Field of Classification Search

CPC ..... H01R 2103/00; H01R 13/7032; H01R 24/46; H01R 13/707003; H01R 13/7033

USPC ..... 439/188, 489, 955

See application file for complete search history.

(56) References Cited

U.S. PATENT DOCUMENTS

| | | | | |
|---|---|---|---|---|
| 7,635,280 | B1 * | 12/2009 | Crumlin | H01R 13/7039 439/489 |
| 8,721,370 | B2 * | 5/2014 | Liu | H01R 13/6658 439/660 |
| 8,747,147 | B2 * | 6/2014 | Yu | H01R 13/7031 439/108 |
| 8,814,583 | B2 * | 8/2014 | Naito | H01R 24/60 439/188 |
| 8,905,779 | B2 | 12/2014 | Little et al. | |
| 8,956,179 | B2 * | 2/2015 | MacDougall | H01R 13/641 439/489 |
| 8,974,240 | B2 * | 3/2015 | Yu | H01R 29/00 439/188 |

FOREIGN PATENT DOCUMENTS

CN 202712639 U 1/2013

* cited by examiner

*Primary Examiner* — Phuong Dinh

(74) *Attorney, Agent, or Firm* — Wei Te Chung; Ming Chieh Chang

(57) ABSTRACT

An electrical connector (100) includes an insulative housing (1) and a plurality of detecting contacts (5) mounted into the insulative housing (1). The insulative housing (1) includes a base portion (11) and a tongue plate (12) extending from the base portion (11). The detecting contacts (5) include two first detecting contacts (51). The base portion (11) defines a receiving cavity (1130) passing through the base portion along an upper to down direction. The base portion includes a resisting portion (1152) disposed behind the receiving cavity. Each of the first detecting contacts includes a first main portion (512) received in the receiving cavity and a first contacting portion (511) extending from the first main portion forwardly. The resisting portion (1152) supports the first main portion (512) forwardly to prevent the first detecting contact from being pushed and dropping from the electrical connector when a plug connector is inserted.

10 Claims, 6 Drawing Sheets

ELECTRICAL CONNECTOR WITH DETECTING CONTACTS

BACKGROUND OF THE INVENTION

1. Field of the Invention

The present invention relates to an electrical connector, and more particularly to an electrical connector having a plurality of detecting contacts.

2. Description of Prior Arts

CN202712639U, published on Jan. 3, 2013 discloses a standard USB socket connector. The USB socket connector includes an insulative housing, a plurality of contacts received in the insulative housing, a shell covering the insulative housing, and two detecting contacts mounted into the insulative housing. The insulative housing includes a base portion and a tongue plate extending from the base portion forwardly. The tongue plate includes a mating face, a supporting face opposite to the mating face, a plurality of contact receiving slots recessed from the supporting face, and an isolating wall disposed behind the contact receiving slots. The insulative housing includes a receiving space defined by the isolating wall and the base portion, and the detecting contacts are received in the receiving space. The detecting contact includes a detecting portion disposed below the supporting face, and the detecting portion is received in the receiving space. As the supporting face of the tongue plate includes a plurality of contact receiving slots, a structure of the tongue plate is complex. It is not convenient to produce the insulative housing.

An electrical connector having a plurality of detecting contacts in a simple construction is desired.

SUMMARY OF THE INVENTION

An electrical connector includes an insulative housing, a plurality of contacts received in the insulative housing, a plurality of detecting contacts mounted into the insulative housing, and a shell. The insulative housing has a base portion, a front surface disposed in front of the base portion, and a tongue plate extending from the front surface of the base portion. The tongue plate has a mating face and a supporting face opposite to the mating face. The contact has a mating portion mounted onto the supporting face. The detecting contacts have a plurality of first detecting contacts. The base portion has an upper surface and a receiving cavity recessed from the upper surface downwardly, and the receiving cavity extends through the base portion along an upper to lower direction. The base portion has a resisting portion disposed behind the receiving cavity. The first detecting contact has a first main portion received in the receiving cavity and a first contacting portion extending from the first main portion forwardly. The first contacting portion extends beyond the mating face and the resist portion supports the first main portion forwardly.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
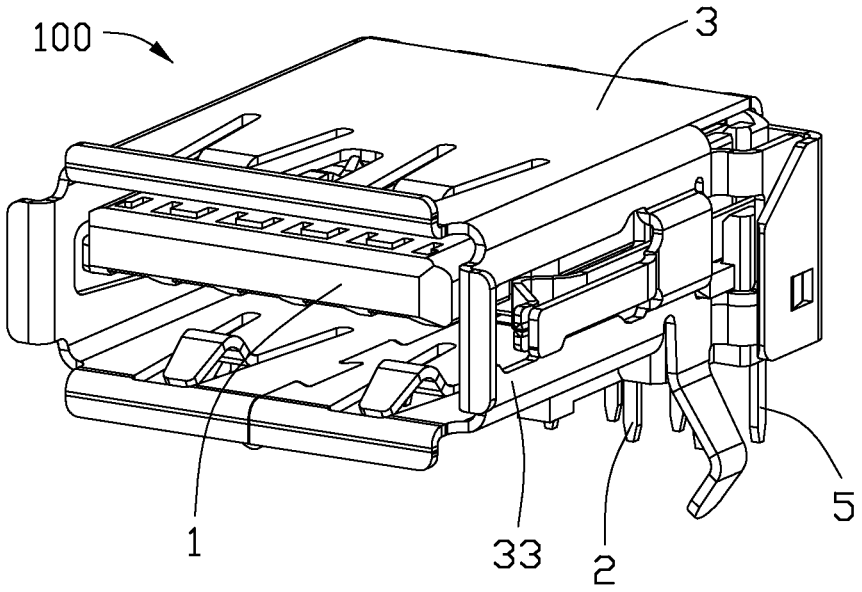
FIG. 1 is a perspective view of an electrical connector in accordance with the present invention.
Figure 2:
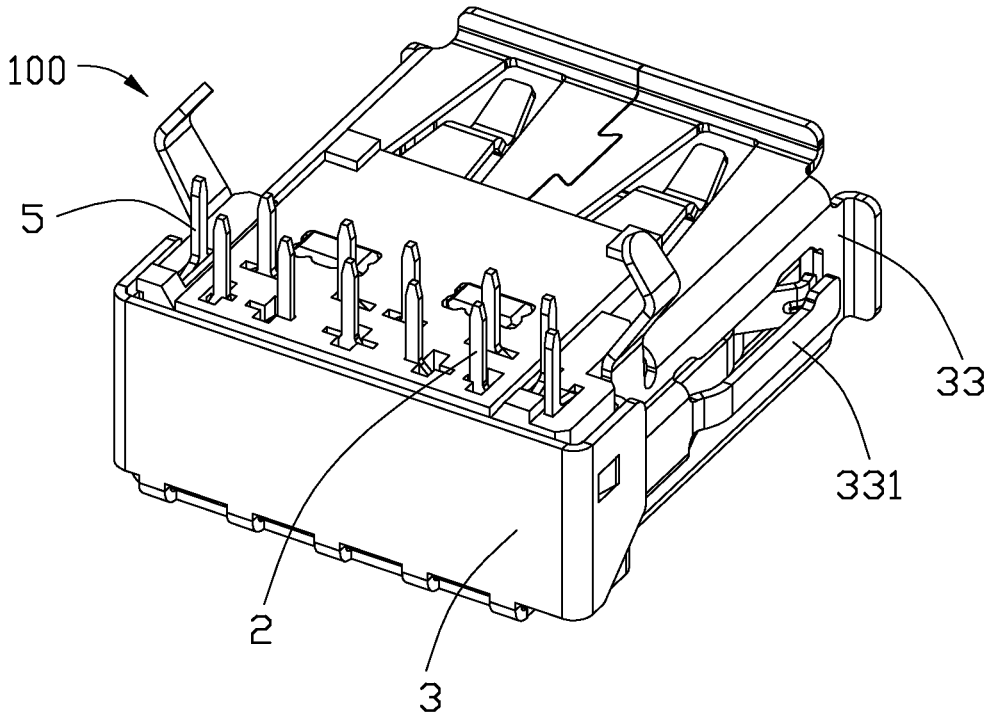
FIG. 2 is another perspective view of an electrical connector as shown in FIG. 1.

Reference will now be made to the drawing figures to describe the present invention in detail.

FIGS. 1-6 show an electrical connector 100 used for being mounted onto an external printed circuit board. The electrical connector 100 includes an insulative housing 1, a plurality of contacts 2 received in the insulative housing 1, a shell 3 covering the insulative housing 1, a plurality of detecting contacts 5, and a contact block 6.

Figure 3:
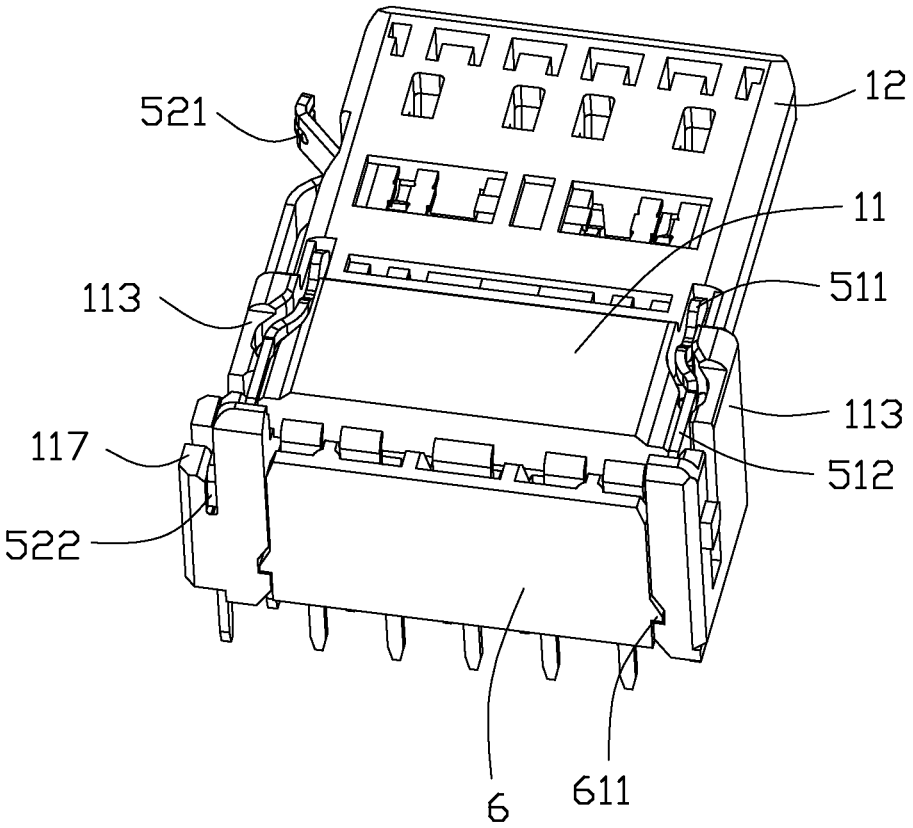
FIG. 3 is a perspective view of an electrical connector without a shell in FIG. 2.
Figure 4:
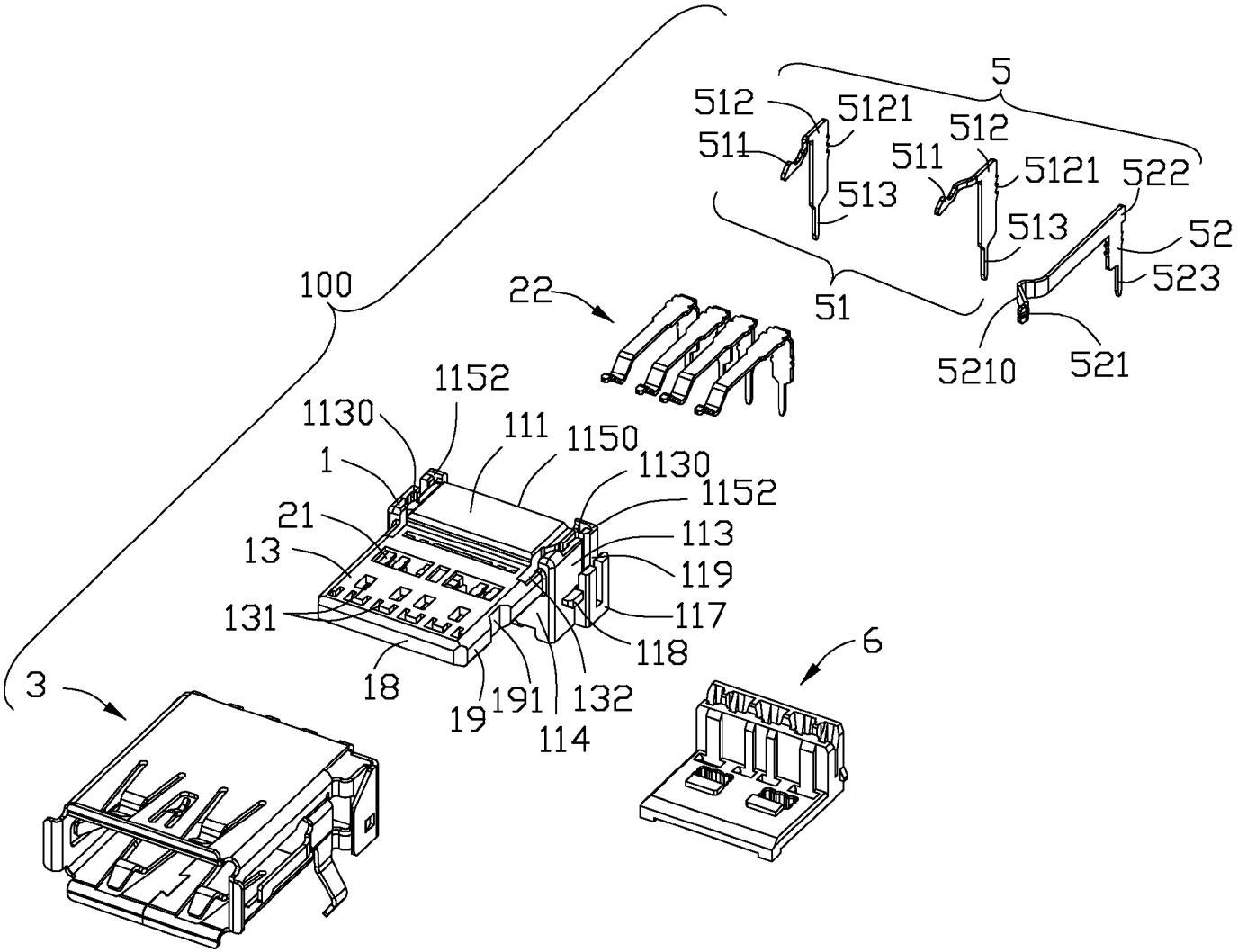
FIG. 4 is an exploded view of the electrical connector in FIG. 2.
Figure 5:
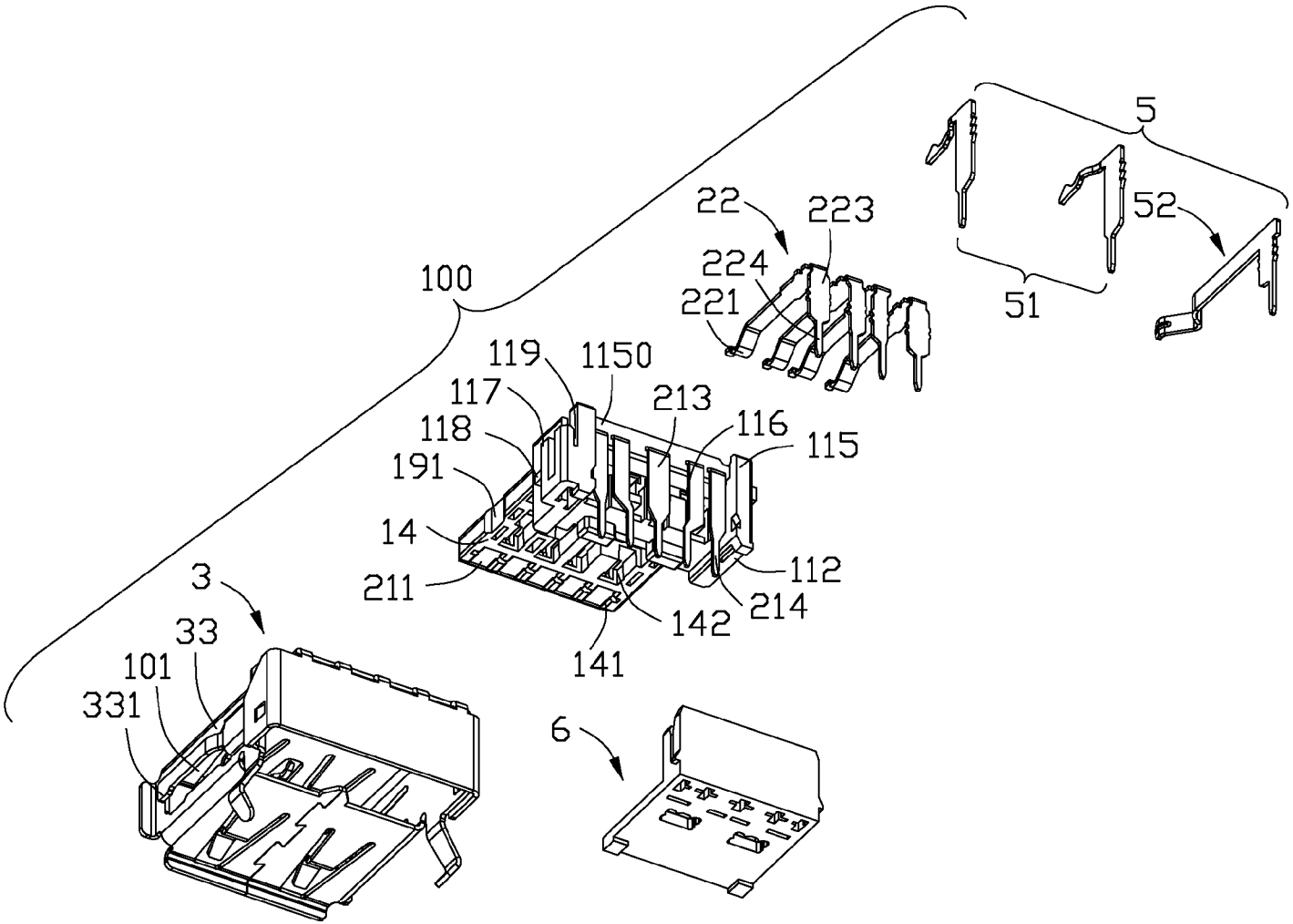
FIG. 5 is another exploded view of the electrical connector in FIG. 4.
Figure 6:
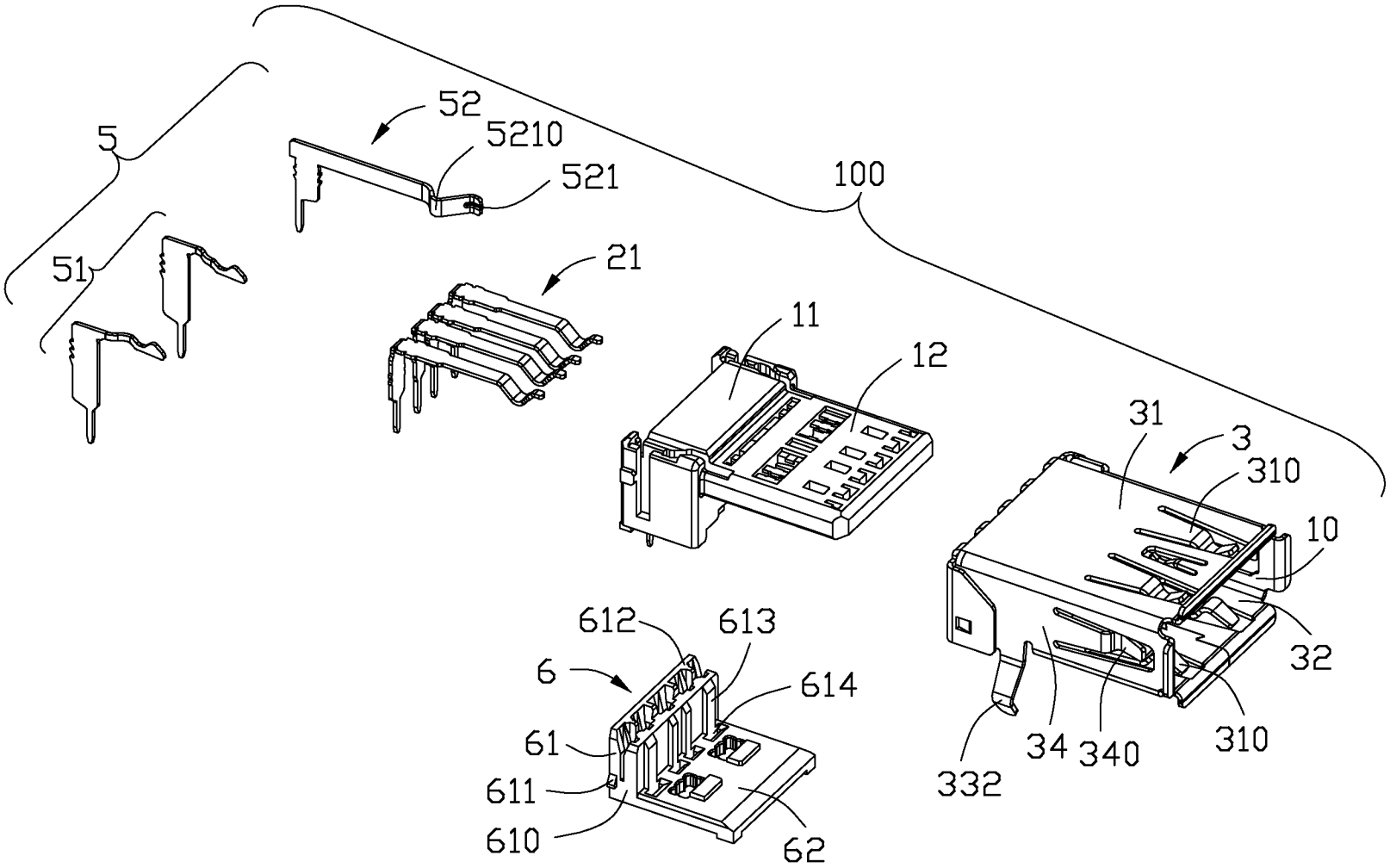
FIG. 6 is another exploded view of the electrical connector in FIG. 5.

FIGS. 3-5 show the insulative housing 1 including a base portion 11 and a tongue plate 12 extending from the base portion 11 forwardly. The base portion 11 includes an upper surface 111, a lower surface 112, two lateral portions 113, a front surface 114, and a rear surface 115. The base portion 11 includes two receiving cavities 1130 recessed from the upper surface 111 downwardly, and the two receiving cavities 1130 are defined at two sides of the base portion 11. The base portion 11 also includes a receiving space 1150 recessed from the rear surface 115 forwardly, and the contact block 6 is received in the receiving space 1150. The two receiving cavities 1130 are not connected with the receiving space 1150. The base portion 11 includes two resisting portions 1152 disposed behind the receiving cavity 1130 respectively, and the resisting portions 1152 are used for supporting the detecting contacts 5 forwardly. The receiving cavity 1130 extends through the lateral portions 113 outwardly and through the lower surface 112 of the base portion 11 downwardly, but does not extend through the rear surface 115. The base portion 11 includes a plurality of positioning slots 116, and the positioning slots 116 extend through the base portion 11 along a front-to-back direction for receiving and positioning the contacts 2. The positioning slots 116 are connected with the receiving space 1150. The positioning slots 116 are defined between the two receiving cavities 1130. The base portion 11 includes an additional portion 117, a supporting platform 118 disposed in front of the additional portion 117, and a fixing cavity 119 defined between the lateral portion 113 and the additional portion 117. The additional portion 117 is defined on the lateral portion 113 on the left. The fixing cavity 119 is connected with the receiving cavity 1130.

FIGS. 4-5 show the tongue plate 12 including a mating face 13 defined on upside of the tongue plate 12, a supporting face 14 opposite to the mating face 13, a front face 18, and two lateral faces 19. The mating face 13 includes a plurality of positioning holes 131. The tongue plate 12 includes a front end and a rear end. The tongue plate 12 includes a plurality of first receiving slots 141 recessed from the supporting face 14 at the front end thereof and a plurality of second receiving slots 142 recessed from the supporting face 14 at the rear end thereof. The first receiving slots 141 are not connected with the second receiving slots 142. The second receiving slots 142 are connected with the positioning slots 116 of the base portion 11. The tongue plate 12 includes two spaces 132 each recessed from the mating face 13 downwardly at two sides thereof, and the space 132 is connected with the receiving cavity 1130 and used for receiving and fixing the detecting contacts 5. The tongue plate 12 includes a recess 191 recessed from one of the lateral faces 19 inwardly on the left of the tongue plate 12.

FIGS. 2-5 show the contacts including a plurality of first contacts 21 inserted molded into the tongue plate 12 and a plurality of second contacts 22 received in the second receiving slots 142 respectively. The first contact 21 includes a first mating portion 211 received in the first receiving slot 141, and the first mating portion 211 is disposed inside of the supporting face 14. The second contact 22 includes a second mating portion 221 received in the second receiving slot 142 and extending beyond the supporting face 14 of the tongue plate 12.

FIGS. 4-5 show a shell 3 including an upper wall 31, a lower wall 32, a left wall 33, and a right wall 34. The upper wall 31 and the lower wall 32 each include two first elastic slices 310 protruding inwardly. The right wall 34 includes a second elastic slice 340 protruding inwardly. The first elastic slices 310 and the second elastic slice 340 are used for holding a plug connector. The left wall 33 and the right wall 34 each include a mounting foot 332 extending downwardly, and the mounting foot 332 is used for being mounted onto the external printed circuit board. The left wall 33 includes a detecting elastic slice 331 protruding from the left wall outwardly.

The detecting contacts 5 include a pair of first detecting contacts 51 received in the receiving cavities 1130 respectively and a second detecting contact 52 received into the fixing cavity 119. The first detecting contacts 51 extend vertically. The first detecting contact 51 includes a first main portion 512, a soldering foot 513 extending from one end of the first main portion 512 downwardly and beyond the lower surface 112 of the base portion 11, and a first contacting portion 511 extends from the other end of the first main portion 512 forwardly to the space 132 of the tongue plate 12. The first main portion 512 includes a plurality of barbs 5121. The first detecting contacts 51 are mounted into the receiving cavity 1130 from the upper to lower direction. The barbs 5121 of the first detecting contacts 51 engage with the resisting portion 1152 of the base portion 11, so that the first detecting contacts 51 are received in the receiving cavities 1130 steadily. When a plug connector is inserted into the electrical connector 100, the resisting portion 1152 holds the first main portion 512 of the first detecting contact 51 forwardly. The first contacting portion 511 extends along the upper to lower direction and beyond the mating face 13 of the tongue plate 12.

The second detecting contact 52 includes a second main portion 522 received in the fixing cavity 119, a second contacting portion 521 extending from one end of the second main portion 522 forwardly to a free space 101, and a second soldering foot 523 extending from the other end of the second main portion 522 downwardly. The second soldering foot 523 is used for being mounted onto the external printed circuit board. The second contacting portion 521 includes a projecting portion 5210 protruding to the recess 191. The second contacting portion 521 is closed to a front edge of the tongue plate 12, and The first contacting portion 511 is disposed behind the tongue plate 12 and is closed to the front surface 114 of the base portion 11.

The electrical connector 100 can not only mate with a standard USB plug connector, but also mate with a USB PD plug connector used for transferring large current. The electrical connector 100 can identify a type of the plug connector by the two first detecting contacts 51 and the second detecting contact 52. A mating portion of the USB PD connector is longer than a mating portion of the standard USB plug connector. When the standard USB connector is inserted into the electrical connector 100 completely, a shell of the standard USB connector presses the projecting portion 5210 of the second contacting portion 521 outwardly. Then the second contacting portion 521 moves outwardly and engages with the detecting elastic slice 331 of the electrical connector 100. As the standard USB plug connector can not touch the first contacting portion 511 of the first detecting contact 51, the first contacting portion 511 can not transfer signal to the other first detecting contact 51 by the shell of the plug connector, so the electrical connector 100 can identify the standard USB plug connector. When the USB PD plug connector with the longer mating portion is inserted into the electrical connector 100, the longer mating portion can touch the first contacting portion 511 of the first detecting contact 51, and the first detecting contact 51 can transfer signal to the other first detecting contact 51 by the shell of the plug connector, then the electrical connector 100 can identify the USB PD connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing, the insulative housing having a base portion with a front surface and a tongue plate extending forwardly from the front surface of the base portion, the base portion having an upper surface and a receiving cavity recessed from the upper surface downwardly, the receiving cavity extending through the base portion along an upper to down direction, the base portion having a resisting portion disposed behind the receiving cavity, the tongue plate defining a mating face and a supporting face opposite to the mating face;

a plurality of contacts, each of the contacts having a mating portion exposed on the supporting face;

a first detecting contact, the first detecting contact having a first main portion received in the receiving cavity and a first contacting portion extending forwardly from the first main portion to an upper side of the mating face, the resisting portion of the base portion supporting the first main portion forwardly; and a shell mounted to the insulative housing, wherein the receiving cavity further extends on the tongue plate to define a space, and the space extends upwardly through the mating face of the tongue plate, and the first contacting portion of the first detecting contact is received in the space, wherein the base portion defines a plurality of positioning slots extending through the base portion along a front-to-back direction, and the receiving cavity is outside of the positioning slots, wherein the base portion has two lateral portions, a rear face and a receiving space recessed from the rear face forwardly, and the resisting portion is aligned to the receiving cavity along the front-to-back direction, and the resisting portion is defined outside of the receiving space.

2. The electrical connector as claimed in claim 1, wherein the base portion has an additional portion defined outside of the lateral portion, and the base portion also has a fixing cavity defined between the additional portion and the lateral portion, and the electrical connector further has a second detecting contacts received in the fixing cavity.

3. The electrical connector as claimed in claim 2, wherein the fixing cavity is configured to T-shaped.

4. The electrical connector as claimed in claim 3, wherein the first detecting contacts has a first extending portion received in the space and the receiving cavity, and the second detecting contact has a second extending portion defined outside of the lateral portion of the base portion.

5. The electrical connector as claimed in claim 4, wherein the tongue plate has two lateral faces connecting the mating face with the supporting face along the upper to down direction, and the tongue plate also has a recess recessed from one of the two lateral faces, and the second detecting contact has a second contacting portion extending forwardly from the second extending portion and being received in the recess.

6. The electrical connector as claimed in claim 5, wherein the fixing cavity is communicated with the receiving cavity.

7. The electrical connector as claimed in claim 6, wherein the first contacting portion is disposed behind the tongue plate, and the first contacting portion is closed to the front surface of the base portion.

8. An electrical connector comprising:

an insulative housing, the insulative housing having a base portion with a front surface and a tongue plate extending forwardly from the front surface of the base portion, the base portion having a receiving cavity extending along a top to bottom direction and having a resisting portion, the tongue plate defining a mating face and a supporting face opposite to the mating face, the receiving cavity extending downwardly through the base portion;

a plurality of contacts, each of the contacts having a mating portion exposed on the supporting face;

a first detecting contact, the first detecting contact having a first main portion received in the receiving cavity and a first contacting portion extending forwardly from the first main portion to be beside the tongue plate, the first main portion being supported forwardly by the resisting portion, and a shell mounted to the insulative housing, wherein the receiving cavity further extends on the tongue plate to define a space, and the space extends upwardly through the mating face of the tongue plate, and the first contacting portion of the first detecting contact is received in the space, wherein the base portion defines a plurality of positioning slots extending through the base portion along a front-to-back direction, and the receiving cavity is outside of the positioning slots, wherein the base portion has two lateral portions, a rear face and a receiving space recessed from the rear face forwardly, and the resisting portion is aligned to the receiving cavity along the front-to-back direction, and the resisting portion is defined outside of the receiving space.

9. The electrical connector as claimed in claim 8, wherein the base portion has an additional portion defined outside of the lateral portion, and the base portion also has a fixing cavity defined between the additional portion and the lateral portion, and the electrical connector further has a second detecting contacts received in the fixing cavity.

10. An receptacle connector for mating with a plug connector having an outer metallic shell enclosing a mating port thereof, comprising:

an insulative housing including a base and a mating tongue extending forwardly therefrom along a front-to-back direction;

a plurality of passageways formed in the housing;

a plurality of first terminals disposed in the corresponding passageways, respectively, with corresponding up-and-down deflectable mating sections exposed upon a mating face of the mating tongue in a vertical direction perpendicular to said front-to-back direction; and a plurality of second terminals disposed in the housing with corresponding stationary mating sections exposed upon said mating face of the mating tongue in front of the deflectable mating sections in said front-to-back direction; wherein the front detecting terminal is positioned to be adapted for contacting an outer face of the metallic shell of the plug connector to be outwardly deflected while the rear detecting terminal is positioned to be adapted for contacting an inner face of the metallic shell of the plug connector to be inwardly deflected; wherein said front detecting terminal is deflectable in a transverse direction perpendicular to both said front-to-back direction and said vertical direction while said rear detecting terminal is deflectable in said vertical direction, wherein the base forms a receiving cavity to receive the rear detecting terminal, and a fixing cavity to receive the front detecting terminal, said receiving cavity compliantly receives a deflectable section of said rear detecting terminal, wherein the rear detecting terminal forms an offset section along the transverse direction, wherein a thickness direction of all said front detecting terminal and a thickness direction of all said rear detecting terminal both extend in a transverse plane perpendicular to said vertical direction, further including a metallic shield to enclose the housing, wherein the shield forms a detecting elastic slice essentially aligned with and adapted for contacting a resilient contacting portion of the front detecting terminal in the transverse direction during mating, and the mating tongue forms a recess beside the resilient contacting portion opposite to the detecting elastic slice in the transverse direction for potentially receiving the contacting portion during unmating.

* * * * *